US005482445A

United States Patent [19]

Achten et al.

[11] Patent Number: 5,482,445

[45] Date of Patent: Jan. 9, 1996

[54] FREE-PISTON ENGINE HAVING A SLIDABLE RING FOR MOVING THE PISTON

[75] Inventors: Peter A. J. Achten, Eindhoven; Theodorus G. Potma, Kaag, both of Netherlands

[73] Assignee: Innas Free Piston B.V., Breda, Netherlands

[21] Appl. No.: 244,186

[22] PCT Filed: Nov. 19, 1992

[86] PCT No.: PCT/NL92/00211

§ 371 Date: May 18, 1994

§ 102(e) Date: May 18, 1994

[87] PCT Pub. No.: WO93/10344

PCT Pub. Date: May 27, 1993

[30] Foreign Application Priority Data

Nov. 19, 1991 [NL] Netherlands ..... 9101933

[51] Int. Cl.[6] ..... F04B 17/00; F04B 35/00; F02B 71/00; F02D 39/00

[52] U.S. Cl. ..... 417/362; 417/323; 417/324; 123/46 SC; 123/46 H

[58] Field of Search ..... 417/364, 323, 417/324; 123/46 SC, 46 H, 24 A

[56] References Cited

U.S. PATENT DOCUMENTS

| | | | |
|---|---|---|---|
| 2,168,829 | 8/1939 | Pescara | 417/364 |
| 2,333,419 | 11/1943 | Fitch | 123/46 H |
| 3,524,436 | 8/1970 | Braun | 417/364 |
| 3,606,591 | 9/1971 | Potma | 417/364 |
| 4,403,474 | 9/1983 | Ruthven | 417/364 |
| 4,705,460 | 11/1987 | Braun | 417/364 |

*Primary Examiner*—Richard A. Bertsch
*Assistant Examiner*—Ted Kim
*Attorney, Agent, or Firm*—Kinney & Lange

[57] ABSTRACT

A free piston engine having a fluid pressure unit which includes a cylinder and a piston arranged within the cylinder and reciprocating therein between the bottom dead center and the top dead center. The piston includes a plunger-shaped piston extension cooperating with the fluid pressure unit. This fluid pressure unit is equipped with an auxiliary member for moving the piston in a direction to its bottom dead center. This auxiliary member includes a connecting channel adapted to communicate a liquid pressure source with a room in which the plunger-shaped piston extension extends and which room is closed on one side by an axial face of the piston extension which is directed such that, by pressure loading the axial face, the piston is moved towards the bottom dead center. The axial face is formed on a ring slidably arranged on the plunger-shaped extension. The plunger-shaped extension includes a stop adapted for engagement by the ring when it is moved for displacing the piston to its bottom dead center.

9 Claims, 1 Drawing Sheet

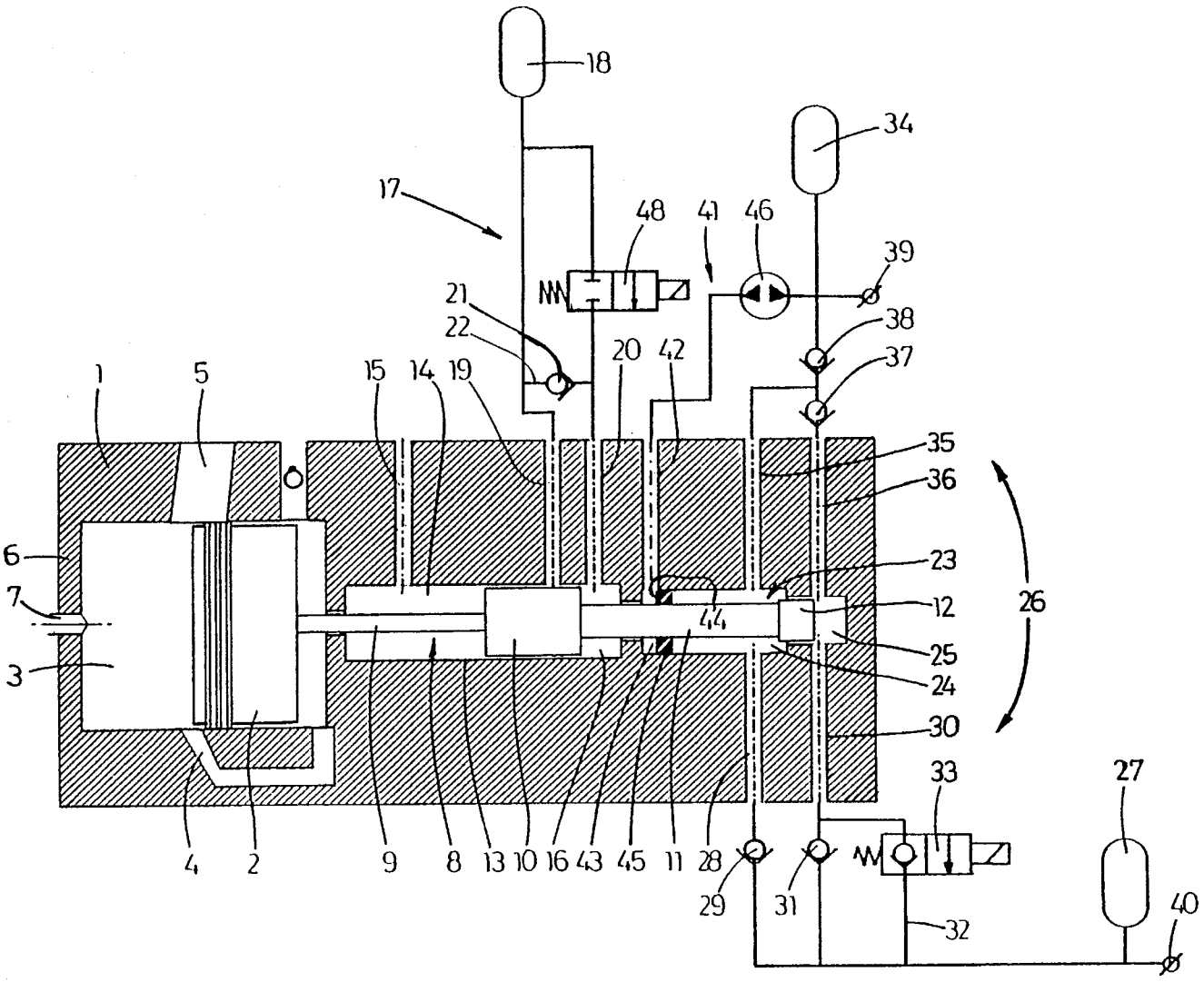
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
48

FREE-PISTON ENGINE HAVING A SLIDABLE RING FOR MOVING THE PISTON

BACKGROUND OF THE INVENTION

The present invention relates to a free-piston engine having a fluid pressure unit, comprising a cylinder and a piston arranged within the cylinder and limiting one side of a combustion room, said piston reciprocating within the cylinder between a first position in which the volume of the combustion room in the cylinder is at a maximum and a second position in which the volume of the combustion room in the cylinder is at a minimum, the piston including a plunger-shaped piston extension cooperating with the fluid pressure unit, said fluid pressure unit being equipped with an auxiliary means for displacing the piston in a direction to its first position, said auxiliary means comprising a connecting channel adapted to communicate a liquid pressure source with a room in which the plunger-shaped piston extension extends and which room is closed on one side by an axial face of the piston extension which is directed such that, by pressure loading this axial face, the piston is moved towards the first position.

In a known embodiment of such a free-piston engine having a fluid pressure unit (see EP-A-0 254 353), said axial face is formed on the plunger-shaped piston extension and the connecting channel of the room of the auxiliary means is connected to a low pressure container during normal operation. In a situation in which the auxiliary means should be used for bringing the piston to its bottom dead centre, such as with a so-called "misfiring", a two-way valve in the connecting channel is switched such that the room is communicated through the connecting channel with a source of higher pressure, such as a compression pressure accumulator.

This prior art free-piston engine has the disadvantage that during normal operation with each compression and expansion stroke of the piston, the reduction and enlargement of the volume of the room cause hydraulic liquid to be forced out from and sucked-in again into said room. This leads to great displacements of hydraulic liquid adversely affecting the efficiency of the free-piston engine. Also, at the start of the expansion stroke of the vehicle, where the piston acceleration is very great, cavitation is caused in the hydraulic liquid sucked-in into said room because this hydraulic liquid cannot follow the acceleration of the axial face formed on the piston. This cavitation is highly undesirable because of the detrimental effects caused thereby, such as vibrations and erosion.

It is an object of the present invention to provide a free-piston engine having a fluid pressure unit, wherein said problem is removed in a simple but effective manner.

SUMMARY OF THE INVENTION

For this purpose the free-piston engine according to the invention is characterized in that said axial face is formed on a ring-shaped element slidably arranged on the plunger-shaped extension, said plunger-shaped extension comprising a stop adapted for engagement by the ring-shaped element when it is moved for displacing the piston to its first position.

Due to these measurements, during normal operation of the free-piston engine, the room of the auxiliary means is bordered by the axial face of the ring-shaped element which is not forced to move with the plunger-shaped piston extension of the piston. As a result, the liquid flows into and out of the room will be reduced very substantially or even be fully eliminated if the ring-shaped element is stationary. This may be enforced by a lock, but in most cases it will happen automatically by pressure forces exerted on the oppositely directed axial face on the other side of the ring-shaped element. When a situation occurs in which the auxiliary means should be used in order to bring the piston to the bottom dead centre, the room is pressurized thereby pushing away the ring-shaped element so as to move along the plunger-shaped extension until it runs into the stop of the plunger-shaped extension, whereafter the ring-shaped element carries the plunger-shaped extension with it. Preceding or during the next compression stroke of the piston, the ring-shaped element is returned to its initial position by the stop or by a pressure differential over the ring-shaped element. Of course, the connecting channel should connect to the room such that it cannot be closed by a radial face of the ring-shaped element.

BRIEF DESCRIPTION OF THE DRAWINGS

The invention will hereafter be elucidated with reference to the drawing showing an embodiment of the free-piston engine having a fluid pressure unit according to the invention by way of example.

The only Figure of the drawing is a very schematic longitudinal sectional view of a free-piston engine and a scheme of the corresponding fluid pressure unit.

DETAILED DESCRIPTION OF THE PREFERRED EMBODIMENTS

The Figure shows an exemplary embodiment of a free-piston engine comprising a cylinder 1 and a movable piston 2 arranged therein. This piston 2 borders one side of the combustion room 3 and is movable between a bottom dead centre in which the volume of the combustion room 3 is at a maximum, and a top dead centre in which the volume of the combustion room 3 is at a minimum. To the combustion room connects an air inlet 4 and a combustion gas outlet 5. In a cylinder head bordering the combustion room 3 on the other side there is mounted an injector 7 for injecting liquid fuel, such as diesel oil, into the combustion room 3. During the compression stroke of the piston 2, that is during the displacement of the piston 2 from the bottom dead centre to the top dead centre, air supplied through the air inlet 4 into the combustion room 3 is compressed, then liquid fuel is injected into the combustion room through the injector 7, and said fuel is spontaneously combusted under influence of pressure and temperature within the combustion space 3 leading to expansion of the fuel-air mixture in the combustion room 3 causing the piston 2 to make an expansion stroke towards the bottom dead centre.

To convert mechanical energy rendered to the piston 2 during the expansion of the fuel-air mixture into hydraulic energy and to convert hydraulic energy into a movement of the piston in order to make a compression stroke, the piston 2 is equipped with a plunger-shaped piston extension 8. This piston extension 8 includes, as seen from the piston 2, a first rod section 9, a first plunger section 10, a second rod section 11 and a second plunger section 12.

The first plunger section 10 is adapted to move within a first chamber 13 and borders on one side a room 14 communicating with the environment through a channel 15 and bordering on the other side a room 16 used for causing the piston 2 to make a compression stroke. For this purpose, the unit includes a preferably hydraulic compression pressure section 17 having a compression pressure accumulator 18, a first connecting channel 19 between the room 16 and the compression pressure accumulator 18 and a second connecting channel 20 between the compression pressure accumulator 18 and the room 16. This second connecting channel 20 incorporates a two-way valve 48 switchable between a first position for closing the second connecting channel 20 (as shown in FIG. 1) and a second position in which hydraulic liquid may flow from the compression pressure accumulator 18 to the room 16. To start a compression stroke of the piston 2, between the first and second connecting channel 20 is arranged an intermediate line 22 having a quick non-return valve 21. It closes at the end of the expansion stroke of the piston 2.

The second plunger section 12 is adapted to move within a second chamber 23 having a first chamber portion 24 and a second chamber portion 25 the diameter of which is smaller than that of the first chamber portion and in which the second plunger section 12 sealingly fits. The second plunger section 12 has the function to convert the pneumatic energy stored in the piston 2 into hydraulic energy during the expansion stroke and, for this purpose, cooperating with a working section 26 of the hydraulic unit. This working section includes a low pressure accumulator 27 and a first supply channel 28 between the first chamber portion 24 and the low pressure accumulator 27, which comprises a non-return valve 29, and a second supply channel 30 between the second chamber portion 25 and the low pressure accumulator 27, which comprises a quick non-return valve 31. A by-pass line 32 passing the quick non-return valve 31 includes a two-way valve 33.

The working section 26 further comprises a high pressure accumulator 34, a first discharge channel 35 connecting to the first chamber section 24 of the second chamber 23 and a second discharge channel 36 connecting to the second chamber section 25 of the second chamber 23 and comprising a quick non-return valve 37 and a non-return valve having a low flow resistance 38. The first discharge channel 35 connects to the second discharge channel 36 between the non-return valves 37 and 38. The high pressure accumulator 34 feeds a user 39, which user may for instance consist of the hydrostatic transmission for driving a vehicle. The low pressure side of this hydrostatic transmission may be connected to the low pressure accumulator 27 at 40.

The operation of the compression section 17 and the working section 26 of the hydraulic unit do not form part of the present invention, so that the normal operation will not be elucidated in detail.

The hydraulic unit of the free-piston engine according to the invention comprises an auxiliary means 41 which may be used for bringing the piston 2 to the bottom dead centre, which is necessary when the free-piston engine is started or when the free-piston engine should be restarted after a so-called misfiring.

This auxiliary means 41 comprises a connecting channel 42 connecting on one hand to a room 43 which, in this exemplary embodiment, forms part of the first chamber portion 24 of the second chamber 23 of the working section of the hydraulic unit. This room 43 is bordered by the walls of the first chamber portion 24, the second rod section 11 and the axial face 44 formed on a ring-shaped element 45 arranged concentrically around the second rod section 11 and sealingly engaging the second rod section 11 on its inner circumference and adapted to slide in relation thereto, and sealingly engaging the circumferential wall of the first chamber portion 24 of the second chamber 23 on its outer circumference and adapted to slide in axial relation thereto. The connecting channel 42 is connected with its other end to the high pressure accumulator 34 of the working section, and within the connecting channel 42 there is incorporated a bi-directional pump 46.

The operation of the auxiliary means 41 is as follows.

During the normal operation of the free-piston engine, the ring-shaped element 45 will assume the position of FIG. 1, both during the compression and the expansion strokes of the piston 2. Then, in the compression stroke the second rod section 11 of the piston extension 8 exerts a slip force on the ring-shaped element 45 which is inclined to move the ring-shaped element 45 to the left in FIG. 1. Due to the presence of hydraulic liquid within the room 43 and the connecting channel 42 closed by the stationary pump 46, the ring-shaped element 45 is not able to move further to the left. During the expansion stroke of the piston 2, the second rod section 11 will try to drag along the ring-shaped element 45 indeed, yet within the first chamber portion 24 there is a high pressure counteracting a movement of the ring-shaped element 45. During said operation of the free-piston engine there are hence no useless flows of the liquid in the room 43 and the connecting channel 42 which could adversely affect the efficiency of the free-piston engine. Only the friction between the second rod section 11 and the ring-shaped element 45 produces a very slight loss of energy.

If the auxiliary means 41 is needed for bringing the piston 2 to the bottom dead centre, the bi-directional pump 46 is acting such that the room 43 is pressurized through the connecting channel 42 so that-a pressure force is exerted on the axial face 44 of the ring-shaped element 45. On the other side of the ring-shaped element 45, the first and second chamber portions 24, 25 are brought to a low pressure by switching the two-way valve 33 in the by-pass line 32 and possibly also a similar two-way valve in a by-pass line around the non-return valve 29. The pressure differential over the ring-shaped element 45 will cause it to move within the first chamber portion 24 to the right in FIG. 1 and to first slide over the second rod section 11 until the ring-shaped element 45 abuts against the collar formed by the second plunger section 12 so that the ring-shaped element 45, when it is moved, carries along the second plunger section 12 and hence the piston 2 up to the desired position thereof.

Subsequently, the two-way valve 33 is switched back to the position of FIG. 1 and prior to switching the two-way valve 48 in the compression section 17 in order to start a new compression stroke of the piston 2, the bi-directional pump 46 is driven in reverse sense so that the ring-shaped element 45 is allowed to move back to the initial position of FIG. 1 where it remains out of range of the collar of the second plunger section 12 during the normal operation of the free-piston engine.

It is also conceivable to accommodate the ring-shaped element 45 within a chamber forming part of the compression section of the hydraulic unit, in which the pump 46 may also be connected with the compression pressure accumulator instead of the high pressure accumulator of the working section. The operation of the auxiliary means 41 does not change then.

What is claimed is:

1. A free-piston engine having a fluid pressure unit, comprising:

a cylinder; and a piston arranged within the cylinder to form a combustion room, the piston reciprocating within the cylinder between a first position in which the volume of the combustion room is at a maximum and a second position in which the volume of the combustion room is at a minimum, the piston including:

a plunger-shaped piston extension cooperating with the fluid pressure unit, the plunger-shaped piston extension including an axial face which is directed such that by fluid pressure loading the axial face, the piston is moved towards the first position;

a ring-shaped element slidably arranged along the plunger-shaped extension, the axial face being formed on the ring-shaped element; and a stop adapted for engagement by the ring-shaped element when the ring-shaped element is moved for displacing the piston to the first position.

2. The free-piston engine according to claim 1, further comprising an auxiliary means for displacing the piston in a direction towards the first position, wherein the auxiliary means includes a connecting channel adapted to communicate a liquid pressure source with a second room in which the plunger-shaped piston extension extends, the second room being positioned at a side of the piston opposite to the combustion room, the second room being closed on one side by the axial face.

3. The free-piston engine according to claim 2, further comprising a pump in the connecting channel of the auxiliary means as the pressure source for pressurizing the room.

4. The free-piston engine according to claim 3, wherein the pump connects to a working pressure accumulator.

5. The free-piston engine according to claim 2, wherein the ring-shaped element consists of a ring arranged concentrically around the plunger-shaped extension, and wherein the stop of the plunger-shaped extension is a collar the diameter of which is smaller than that of the second room.

6. Free-piston engine having a fluid pressure unit, comprising a cylinder and a piston arranged within the cylinder and limiting one side of a combustion room, said piston reciprocating within the cylinder between a first position in which the volume of the combustion room in the cylinder is at a maximum and a second position in which the volume of the combustion room in the cylinder is at a minimum, the piston including a plunger-shaped piston extension cooperating with the fluid pressure unit, said fluid pressure unit being equipped with an auxiliary means for displacing the piston in a direction to the first position, said auxiliary means comprising a connecting channel adapted to communicate a liquid pressure source with a second room in which the plunger-shaped piston extension extends and which second room is closed on one side by an axial face of the piston extension which is directed such that, by fluid pressure loading the axial face the piston is moved towards the first position, characterized in that said axial face is formed on a ring-shaped element slidably arranged along the plunger-shaped extension, said plunger-shaped extension comprising a stop adapted for engagement by the ring-shaped element when the ring-shaped element is moved for displacing the piston to the first position.

7. Free-piston engine according to claim 6, wherein a pump is provided in the connecting channel of the auxiliary means as pressure source for pressurizing said room.

8. Free-piston engine according to claim 7, wherein the pump connects to a working pressure accumulator.

9. Free-piston engine according to claim 1, wherein the ring-shaped element consists of a ring arranged concentrically around the plunger-shaped extension, and the stop of the plunger-shaped extension is a collar the diameter of which is smaller than that of the second room.

* * * * *